US007278617B2

(12) United States Patent
Valiulis et al.

(10) Patent No.: US 7,278,617 B2
(45) Date of Patent: Oct. 9, 2007

(54) DISPLAY HOOK AND ASSEMBLY HAVING REDUCED DRAG

(75) Inventors: Thomas E. Valiulis, Rockford, IL (US); Robert Louis Northrup, Jr., Machesney Park, IL (US)

(73) Assignee: Southern Imperial, Inc., Rockford, IL (US)

( * ) Notice: Subject to any disclaimer, the term of this patent is extended or adjusted under 35 U.S.C. 154(b) by 471 days.

(21) Appl. No.: 10/390,444

(22) Filed: Mar. 17, 2003

(65) Prior Publication Data

US 2004/0182975 A1 Sep. 23, 2004

(51) Int. Cl.
*E04G 5/06* (2006.01)
*A47F 5/08* (2006.01)

(52) U.S. Cl. ..... 248/220.31; 211/59.1

(58) Field of Classification Search ..... 248/220.31, 248/220.41, 220.42; 211/54.1, 59.1
See application file for complete search history.

(56) References Cited

U.S. PATENT DOCUMENTS 3,245,547 A * 4/1966 Felkay ..... 248/220.41
3,645,485 A * 2/1972 Gold ..... 248/220.41
4,239,099 A 12/1980 Williams et al.
RE30,706 E 8/1981 Bustos
4,294,363 A 10/1981 Oztekin et al.
4,303,217 A * 12/1981 Garfinkle ..... 248/220.42
4,346,806 A 8/1982 Bustos
4,416,380 A 11/1983 Flum
4,798,297 A * 1/1989 Weiss et al. ..... 211/65
4,835,013 A 5/1989 Heck et al.
4,869,376 A * 9/1989 Valiulis et al. ..... 211/59.1
4,898,406 A * 2/1990 Willius ..... 281/43
4,899,893 A 2/1990 Robertson
4,925,710 A * 5/1990 Buck et al. ..... 428/34.5
4,976,058 A * 12/1990 Valiulis ..... 40/657

(Continued)

FOREIGN PATENT DOCUMENTS

DE 3714222 C1 * 7/1988

OTHER PUBLICATIONS

The Powder Coating Institute, *The Benefits of Powder Coating, What Is Powder Coating*, 1 website page dated Dec. 14, 2003.

(Continued)

*Primary Examiner*—Anita M. King
(74) *Attorney, Agent, or Firm*—Reinhart Boerner Van Deuren P.C.

(57) ABSTRACT

A retail display hook, structure and method is provided for a product display that is self-facing and is both safe and space-saving. The support structure includes a vertical support for receiving a display hook. The display hook includes a back end member structured for attachment to a vertical support; a product arm member supported by and extending forwardly from the back end member, the product arm member structured to display the merchandise via a self-facing configuration such that merchandise when displayed on the retail display hook migrates forwardly toward the retainer member with the retainer member; and a lubricious surface that can be a fluoropolymer or a silicone surface on at least a portion of the product arm member. The fluoropolymer surface or the silicone surface is configured to provide an approximate near zero static coefficient of friction for merchandise being self-faced on the product arm member.

2 Claims, 5 Drawing Sheets

U.S. PATENT DOCUMENTS

| | | | | |
|---|---|---|---|---|
| 5,012,936 | A | 5/1991 | Crum | |
| 5,080,238 | A * | 1/1992 | Hochman | 211/59.1 |
| 5,088,607 | A | 2/1992 | Risafi et al. | |
| 5,114,021 | A * | 5/1992 | Fredrickson | 211/54.1 |
| 5,197,610 | A | 3/1993 | Bustos | |
| 5,222,608 | A * | 6/1993 | Eklof et al. | 211/54.1 |
| 5,240,126 | A | 8/1993 | Foster et al. | |
| 5,469,976 | A | 11/1995 | Burchell | |
| 5,531,336 | A | 7/1996 | Parham et al. | |
| 5,562,217 | A | 10/1996 | Salveson et al. | |
| 5,626,243 | A * | 5/1997 | Brozak, Jr. | 211/59.1 |
| 5,833,077 | A * | 11/1998 | Engel | 211/59.1 |
| 5,855,283 | A | 1/1999 | Johnson | |
| 5,878,895 | A | 3/1999 | Springs | |
| 5,906,283 | A * | 5/1999 | Kump et al. | 211/54.1 |
| 6,131,748 | A * | 10/2000 | Kawasaki et al. | 211/54.1 |
| 6,218,017 | B1 | 4/2001 | Yamashita et al. | |
| 6,273,276 | B1 | 8/2001 | Upton et al. | |
| 6,328,170 | B1 | 12/2001 | Lee | |
| 6,464,089 | B1 | 10/2002 | Rankin, VI | |
| 6,494,894 | B2 | 12/2002 | Mirarchi | |
| 6,536,609 | B2 | 3/2003 | Lake | |
| 6,745,906 | B1 | 6/2004 | Nagel | |
| 6,769,552 | B1 | 8/2004 | Thalenfeld | |
| 6,866,156 | B2 | 3/2005 | Nagel et al. | |
| 6,923,330 | B1 | 8/2005 | Nagel | |
| 2002/0113183 | A1 * | 8/2002 | Mattesky | 248/220.41 |

OTHER PUBLICATIONS

The Powder Coating Institute, *The Benefits of Powder Coating, What Are Its Advantages*, 1 website page dated Dec. 14, 2003.

The Powder Coating Institute, *The Benefits of Powder Coating, Where Is Powder Coating Used?*, 2 website pages dated Dec. 14, 2003.

The Powder Coating Institute, *Powder Coated Mark Program, Powder Coated Tough*, 1 website page dated Dec. 14, 2003.

The Powder Coating Institute, *All About Powder Coating*, 1 website page dated Dec. 14, 2003.

The Powder Coating Institute, *Fast Facts About Powder Coating*, 1 website page dated Dec. 14, 2003.

The Powder Coating Institute, *Converting to Powder Coating Case Study*, 4 website pages dated Dec. 14, 2003.

Chapter 3: *Powder Coating Materials*; pp. 12-19, undated.

* cited by examiner

DISPLAY HOOK AND ASSEMBLY HAVING REDUCED DRAG

FIELD OF THE INVENTION

This invention pertains to display hooks for retain display assemblies, and more particularly relates to a display hook and assembly with reduced drag.

BACKGROUND OF THE INVENTION

In the field of retail display, display assemblies are typically mounted on a vertical support structure representing merchandise to the customer. The vertical structure is typically a pegboard, cross bars, slat wall support, or wire grid support. Display hooks attach to the vertical support typically by attachment of a back portion to the vertical structure. The use of display hooks in retail displays requires careful consideration of the effect the display has on consumers. For example, many display hooks are angled upward causing products on the hook to slide to the back of a product arm. When a product remains at a back of a product arm the product may not be seen by consumers, resulting in lower sales. Furthermore, consumers may assume that a store is not well stocked if product remains at the rear of a product arm of a display hook. The display can therefore appear empty and not presentable because of the configuration and design of a display hook.

The appearance of displays results in retailers spending man-hours to pull products to the front of a product arm. In the retail business, the action of pulling products forward is called "facing" a product. Display hooks that are "gravity fed" assist retailers in facing the product on display hooks by providing a downward angle so that products displayed on the hooks slide toward the front of the hook. However, gravity-fed display hooks typically require an angle sufficient to cause sliding of products. This angulation causes retailers to lose valuable retail space for displaying products. For example, angling a product arm downward 30-45 degrees for gravitational slide, can cause a retailer to lose nearly half a foot of display area as compared to non-gravity fed display hooks. As a result, gravity-fed hooks are unpopular with retailers.

Similar problems with display hooks are present with spring-loaded display hooks. In particular, spring-loaded display hooks require a product-specific spring such that spring tensions are not too strong or too light. Product-specific springs are expensive to produce and the likelihood of re-use is small due to the narrow range of product weights appropriate for each spring. Moreover, heavier products are incompatible with such spring-loaded systems due to the danger related to strong springs in a retail setting. Accordingly, there exists a need to provide a display assembly and more particularly, a display hook that overcomes these difficulties.

BRIEF SUMMARY OF THE INVENTION

An embodiment of the present invention provides for a support structure and a display hook for displaying merchandise that provides a safe, space-saving and self-facing configuration. The display hook has a lubricious surface thereon, the surface allowing for a decreased angulation on a self-facing gravity fed hook and a reduced spring force on a self-facing spring-loaded hook. The lubricious surface can be comprised of a fluoropolymer such as polytetrafluoroethylene (ptfe), which can be either a tape or a coating, or the coating can be comprised of silicone with ultraviolet curing.

In one embodiment, the display hook is coated with a lubricious material on only a portion of the display hook, the portion being that which requires product contact.

These and other advantages of the invention, as well as additional inventive features, will be apparent from the description of the invention provided herein.

DETAILED DESCRIPTION OF THE INVENTION

The following description references the drawings in which like elements in different drawings are identically numbered. The drawings depict selected embodiments and are not intended to limit the scope of the invention.

Figure 1:
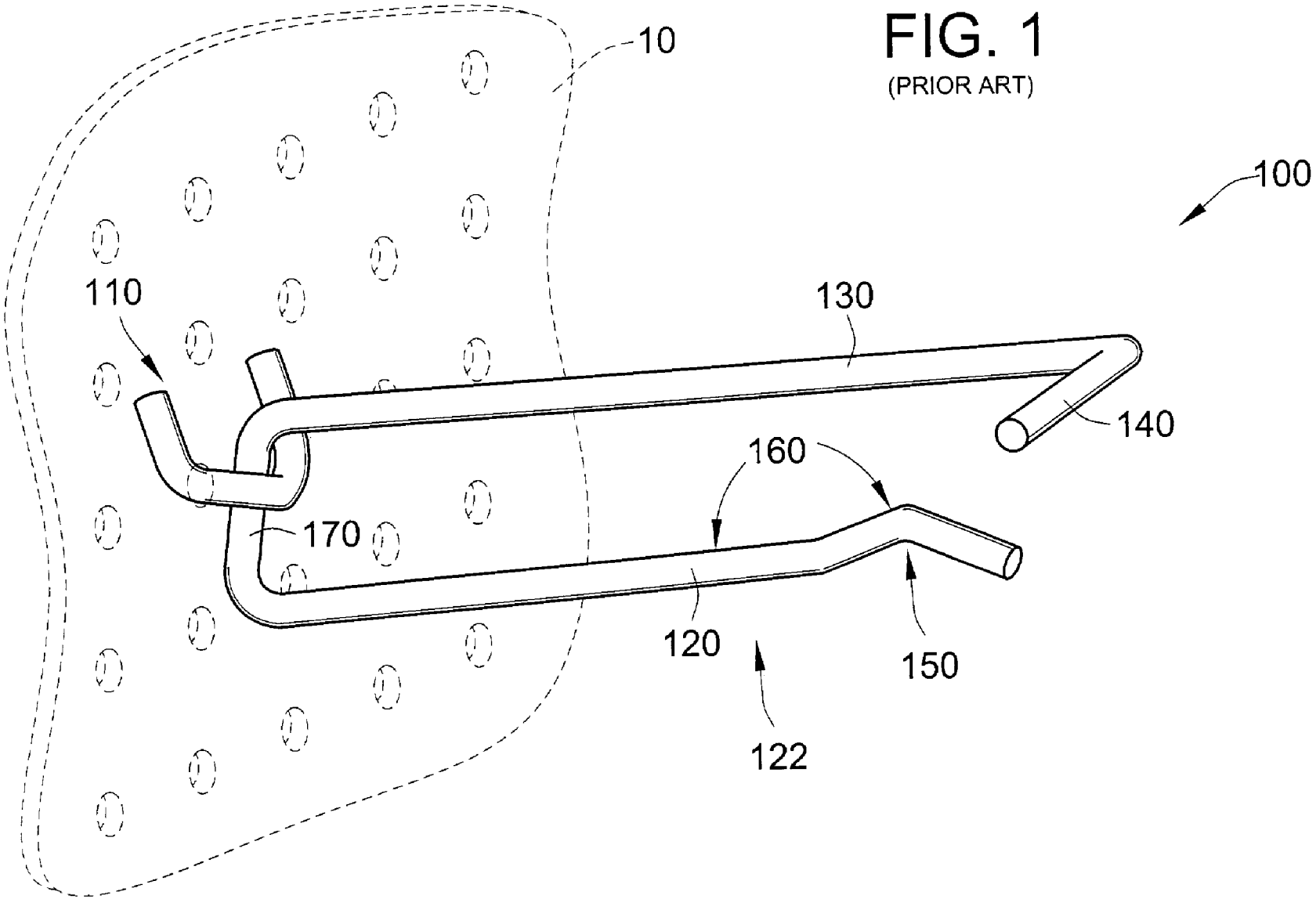
FIG. 1 (PRIOR ART)
FIG. 1, labeled "prior art" illustrates a perspective view of a retail display hook and vertical support structure.

Turning now to the figures, FIG. 1, labeled "prior art", depicts a view of a retail display hook 100, which is typically used for retail displays. The display hook is structured for attachment to vertical support 10. Vertical support 10 has been depicted as a board with a plurality of vertically-spaced apertures, which are used to mount retail display hooks, such as display hook 100. Other vertical supports appropriate for display hooks according to embodiments herein include slat wall supports, cross bar supports and wire grids. Vertical supports can be constructed of, for example, wire, stamped steel, wood or plastic. Display hook 100 generally includes a back member 110 for detachably connecting the display hook 100 to the vertical support 10. Display hook 100 further includes a product arm member 120, which can be constructed to hold retail products, for example. The product arm member 120 can be injection molded of plastic, can be steel-formed wire, or can be stamped steel separately or as part of a one-piece display hook. The length of product arm member 120 can vary from one inch to up to twenty inches or more. An optional portion of a standard display hook includes scanning arm member 130. Scanning arm member 130 typically is constructed as a portion of the display hook with a bent front end 140 that holds a label holder (not shown) in front of products displayed on product arm member 120. Product arm member 120 includes a storage portion 122 and a retainer portion 150. Retainer portion 150 is disposed at an end of the product arm member 120 and includes an upwardly formed bend 160 that forms an angle for keeping products from falling off of the product arm member 120.

Bend 160 is generally upwardly to prevent products from falling off. Bend 160 is deflected from 0 degrees by an amount that depends on several factors. First, the type of retainer 150 makes a difference to bend 160. For example, some display hooks can have a retainer 150 angled up very slightly such that bend 160 must be upward from 0 degrees by 7-15 degrees to prevent products from falling off the product arm member 120. A second factor for bend 160 of the product arm member 120 is the weight of the product to be held on the display hook 100. For very heavy products, a product arm member 120 will bend downwardly, thus possibly requiring an increased upwardly bend 160.

Figure 2:
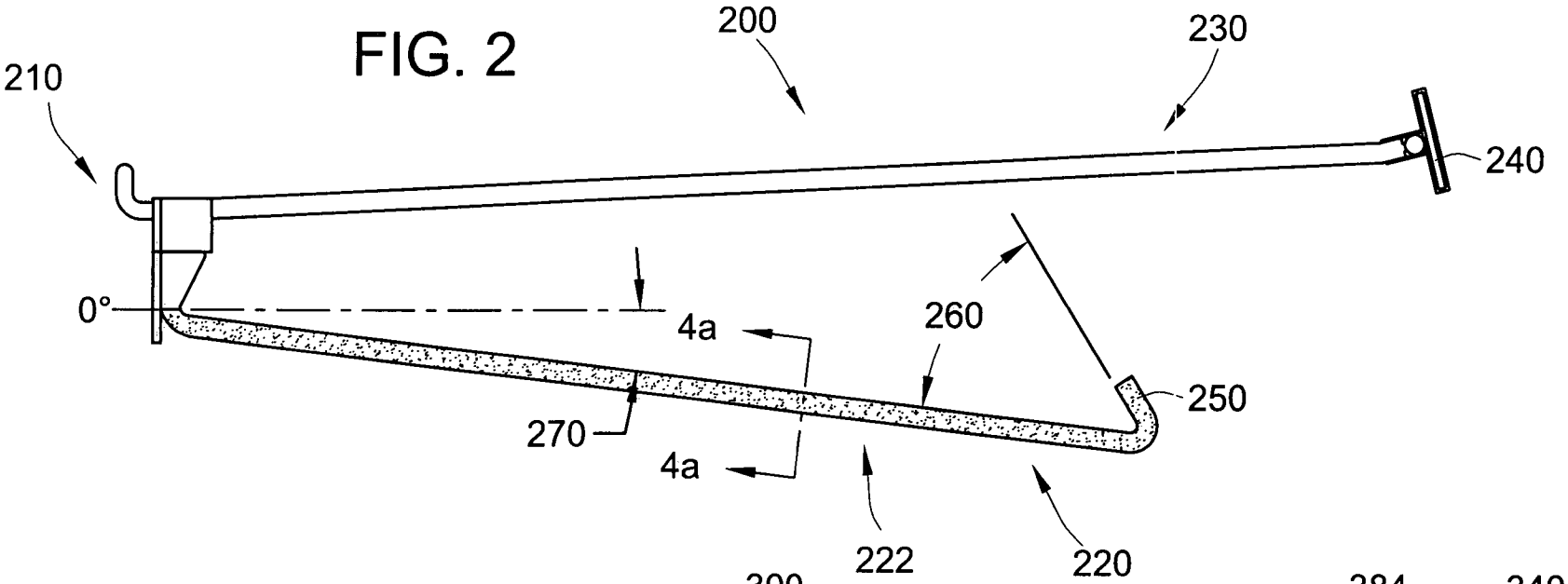
FIG. 2 illustrates a perspective view of a gravity-fed display hook constructed in accordance with the teachings of the present invention.

Referring now to FIG. 2, gravity-fed display hook 200 is shown. A gravity-fed display hook such as display hook 200 assists retailers by providing automatic facing (self-facing) of products. Display hook 200 includes a product arm member 220, which includes storage portion 222 and is integrally formed or connected with retainer member 250 and to a back bracket 210. Retainer member 250 includes an upwardly angled bend 260 interposed between the storage portion 222 and retainer member 250 of the product arm member 220. Gravity-fed hook 200 further includes scanning arm 230 with a first end for a label holder 240 and a label. Gravity-fed display hook 200 is gravity fed in that the product arm member 220 is deflected from 0 degrees downwardly such that a product displayed on the product arm member 220 will slide toward the front tip of the product arm 250. Gravity assists the product to self-face thereby avoiding retailers from having employees pull product to the front of the display arm. The greater the downward angle on the product arm member, the more likely gravity will affect product on the hook.

Typically, gravity-fed display hooks such as display hook 200 will have a retainer member 250 that forms a bend for retaining products thereon that forms an angle relative to the storage portion 222 of product arm member 220 that is appropriate for retaining the type of product suspended from the display hook. The angle can be an acute angle as shown, to a 90-degree angle to assure that product will not fall off product arm member 220 when the product slides forward on the hook and when a consumer removes a front product.

Also shown in FIG. 2, is deflection angle 270, which is a downward angle for allowing gravity to cause products displayed on the product arm member to slide forward. A typical downward angle of a gravity-fed display hook is approximately 30-45 degrees, which causes retailers to lose approximately four inches of display area. For this reason, gravity-fed display hooks are unpopular. However, a reduced angle of less than 30 degrees is possible due to the use of a lubricous surface on the product arm member 220, as further explained below. As one of skill in the art with the benefit of this disclosure will appreciate, a reduced angle 270 is a function of the weight of the product to be displayed.

Figure 3:
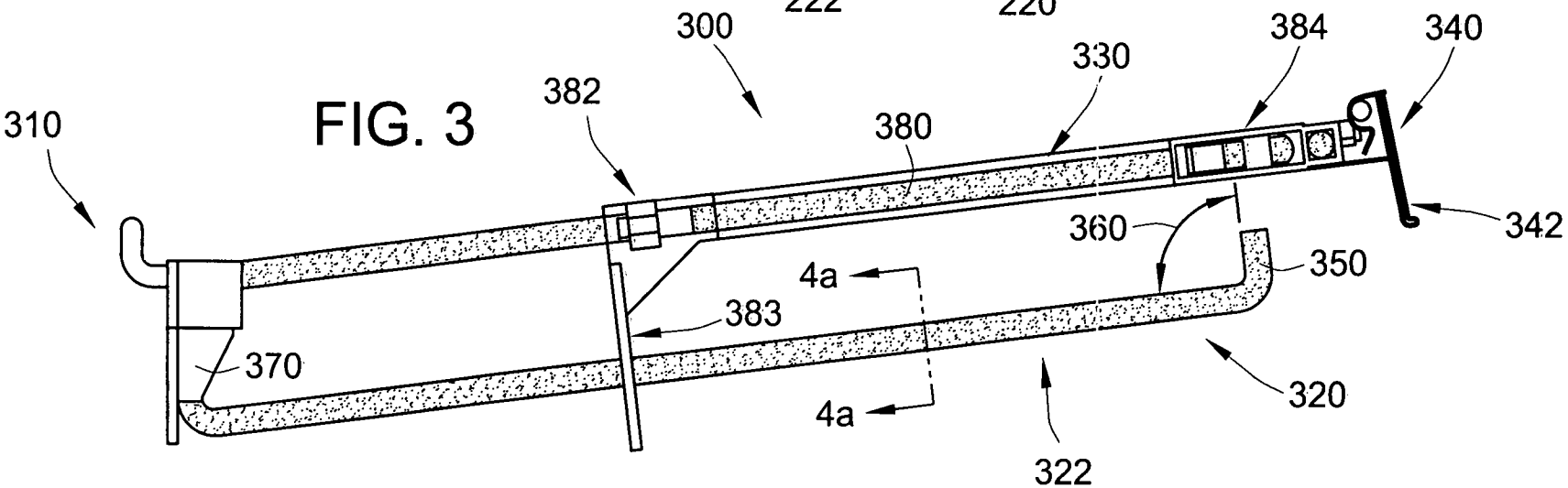
FIG. 3 illustrates a perspective view of a spring loaded display hook constructed in accordance with the teachings of the present invention.

Referring now to FIG. 3 a spring-loaded display hook is shown that illustrates an alternate embodiment. The spring-loaded hook includes a back 310 coupled to a product arm member 320. Back 310 is also coupled to scanning arm member 330 which at a first end thereof includes a label holder member 340. The product arm member 320 includes a storage portion 322 and a retainer member 350 integrally connected with storage portion 322. Retainer member has an upwardly angled bend 360 for retaining products on product arm member 320. Back 310 is shown attached to vertical support 370. Spring-loaded hook 300 is a spring-type display hook that pushes or pulls products on the display along product arm member 320. As one of skill in the art will appreciate, there are several variations of spring-loaded hooks using spring tension for pushing or pulling a product toward the front of a product arm member 320. Typically in each spring-loaded display hook angle 360 at the front of the product arm member 320 is kept at an approximate 90-degree angle to keep products from being pushed or pulled off of the product arm member 320. The spring-loaded hook 300 further includes a product pushing apparatus 382, which includes a plastic or metallic product pusher 383, which is coupled to spring 380. Spring 380 couples the plastic or metal product pusher 383 to pusher support member 384. Pusher support member 384 couples spring 380 to the end of the label holder member 340 and is also coupled to label device 342.

Figure 4B:
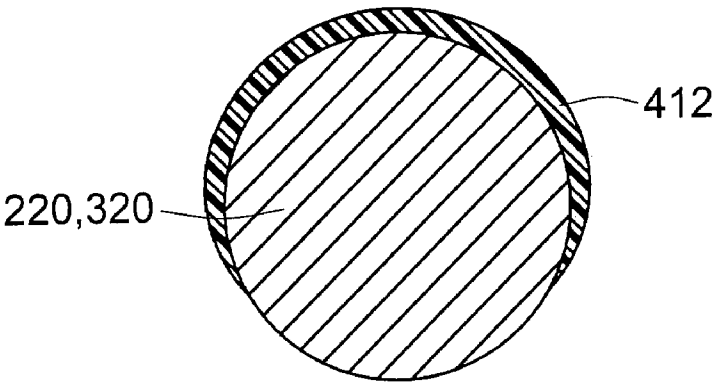
FIG. 4B illustrates another embodiment of the an enlarged cross-sectional view, taken at line 2-2 in FIG. 2.
Figure 4A:
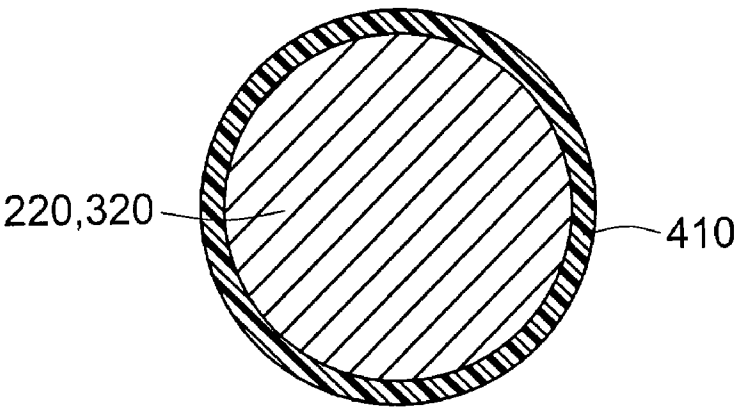
FIG. 4A illustrates an enlarged cross-sectional view, taken at line 2-2 in FIG. 2; an enlarged front view, partially cut away, of the display assembly shown in FIG. 2.

FIGS. 4A and 4B illustrate embodiments of the present invention directed to a display hook having a lubricious surface on product arm member 220 or 320 at cross sections 4*a*-4*a* of product arm 220 and 320 of FIG. 2 and FIG. 3. The coating 410 shown in FIG. 4A surrounds product arm member 220 and 320. The coating 412 shown in FIG. 4B partially surround product arm member 220 and 320. The coating 410 is a circumferential coating, and coating 412 is a partially circumferential coating of product arm member 220 and 320 deposited at least along the exterior perimeter portion of the display arm member 220 and 320, the coating material to create the lubricious coating may include a fluoropolymer such as polytetrafluoroethylene (ptfe), or silicone. The coating can be electrostatically applied via a liquid or powder form. A silicone coating with ultraviolet curing can also create the lubricious coating. Other types of coating are also possible that would be within the scope of the present invention. For example, instead of a coating, the lubricious surface can be via a fluoropolymer tape such as a ptfe tape.

In one embodiment, the display hook 200 may have special plating to enhance adhesion of the coating to the display hook. For example, adhesive binding could assist the adhesive qualities of a bonding for a coating. The lubricious coating on display hook 200 advantageously results in the angle of deflection for product arm member 220 being less than otherwise would be required for self-facing of product on the product arm member 220.

According to embodiments herein, the coating and the silicone coating provide a near-zero coefficient of friction for products placed on display hook 200 and 300. The coefficient of friction on product arm member 220 and 320 is a factor that includes variables such as product weight, the number of products on the product arm and the design of the self-facing configuration.

The importance of the coefficient of friction to the effective product weight of products displayed on a display hook is an important consideration as shown by an exemplary product weight calculation shown in Table 1, below:

TABLE 1

| | |
|---|---|
| Product weight | 2 ounces |
| Number of products on product arm | 10 pieces |
| Total weight to push or slide | 20 ounces |
| Multiply by coefficient of friction (static) | .3 |
| Total force to move in ounces | 6 ounces (20 × 0.3 = 6) |
| TOTAL WEIGHT TO PUSH OR SLIDE | 26 ounces |

As shown in Table 1, spring-loaded display hooks such as spring-loaded display hooks 300, and gravity-fed display hooks such as hook 200 are affected by the coefficient of friction of the hook. As shown, the static coefficient of friction effectively alters the weight of products to be pushed. By using a fluoropolymer such as ptfe coating or a silicone coating on the product arm member, a near zero drag coefficient can significantly reduce the amount of weight that needs to be pushed or gravity affected on display hooks 200 and 300.

By reducing the total weight that requires pushing or sliding, a retailer is significantly advantaged by providing a safer spring-loaded display hook system for display hooks. Strong springs in pushed systems are unsatisfactory due to the strength of the spring creating a great variation of springs required for different types of products. Likewise, a greater angle on a gravity-fed display hook 200 requires excessive amounts of space for displaying products. By reducing the drag coefficient via a fluoropolymer coating or silicone coating, the spring strength of the spring-loaded display hook 200 can be narrowed and the angle required for gravity-fed display hooks can be reduced.

The angling for self-facing on a gravity-fed display hook such as gravity-fed display hook 200 required when using either a fluoropolymer such as ptfe or silicone on the product arm member can be less than 30 degrees. More particularly, referring to Table 2, below, in combination with FIG. 5, a graph illustrates the required force in ounces required to cause self-facing of a one pound article on display hook 200 at different angles. As shown, a galvanized hook at a ten degree inclination requires about 11.4 ounces of force, and at a negative ten degree declination requires three ounces of force. In sharp contrast to the galvanized display hook, a flouropolymer coated display hook requires less than half the force at a ten degree inclination to move the one pound article (about 4.8 oz. of force); and at a ten degree declination, no force is required to move the article (about 0 oz. of force). Comparing a powder coated display hook with the fluoropolymer coated display hook, the results show that less force is required to move a one pound article. For example, the display hook 200 can self-face a one pound article at a force of about 2.1 ounces when the retail display hook is level.

TABLE 2

| | 10° | 0° | −5° | −10° |
|---|---|---|---|---|
| Galvanized | 11.4 | 6.2 | 4.1 | 3 |
| Powder Coated | 8.6 | 3.5 | 2.1 | 0 |
| Fluoropolymer Coated | 4.8 | 2.1 | 0.5 | 0 |

Figure 5:
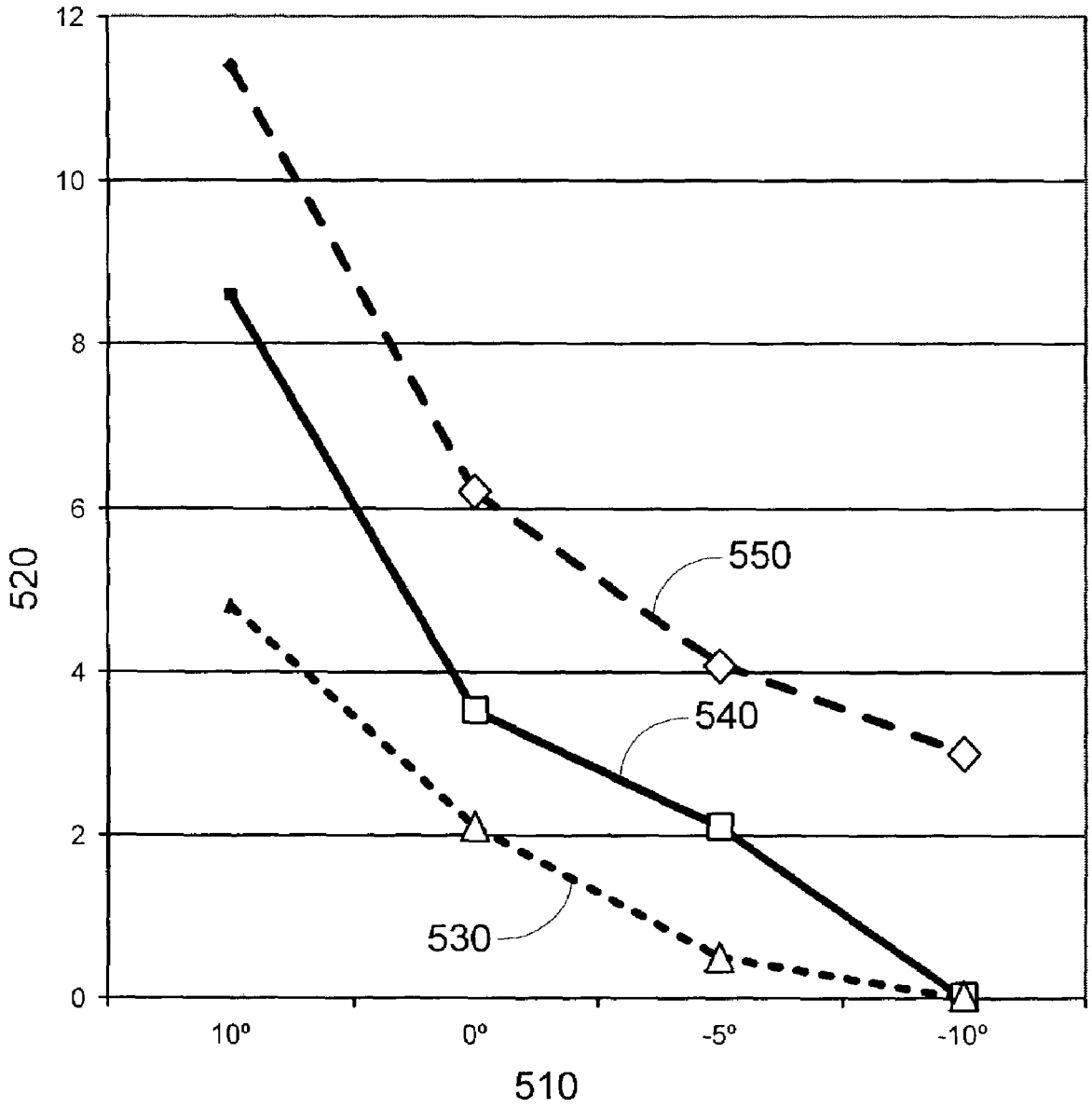
FIG. 5 illustrates a graph in accordance with an embodiment of the present invention.

The results shown in Table 2 are provided in graph format in FIG. 5. Specifically, FIG. 5 illustrates an x-axis 510 representing an angle of inclination, and a y-axis 520 representing an amount of force in ounces required to move a one pound article suspended on a display hook, such as display hook 200. Line 530 represents a fluoropolymer-coated hook, such as a Teflon™-coated display hook; line 540 represents a powder-coated display hook; and line 550 represents a galvanized-type display hook. As shown, the fluoropolymer-coated display hook requires less force to move a one-pound article than either the powder-coated hook or the galvanized hook.

Figure 6:
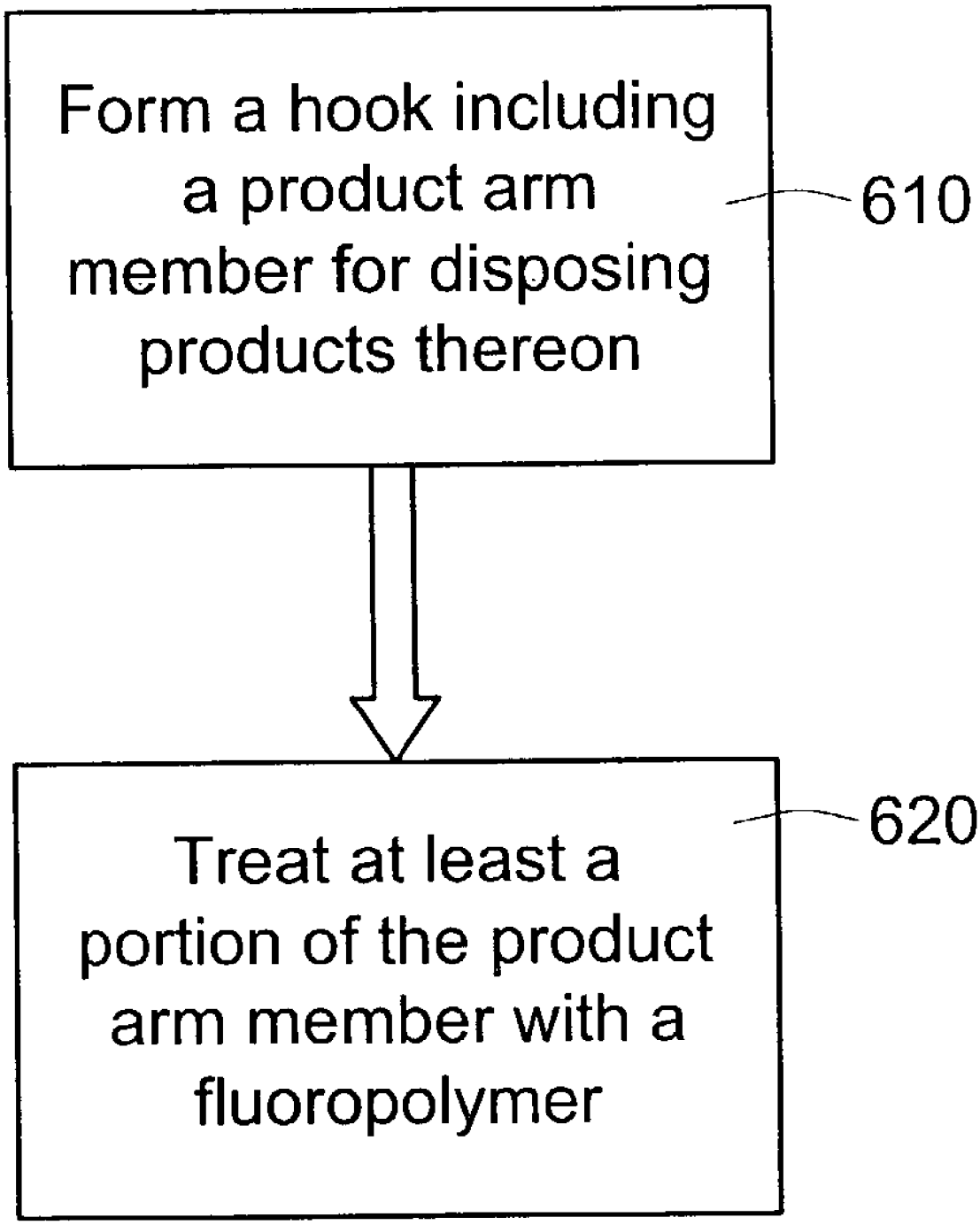
FIG. 6 illustrates a flow diagram of a method in accordance with the teachings of the present invention.

Referring now to FIG. 6, a method for manufacturing a display hook as described herein is provided. Block 610 provides for forming a hook including a product arm member configured for disposing products thereon. Block 620 provides for treating at least a portion of the product arm member with a flouropolymer. The flouropolymer can be ptfe or another slick coating material as will be appreciated by those of skill in the art of coatings with the benefit of this disclosure. The coating provides a slick surface thereby providing a safer spring-loaded display hook assembly and by providing decreased shelf space for gravity-fed display hook assemblies.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display hook for displaying merchandise, the retail display hook comprising:

a back end member structured for attachment to a vertical support; and a product arm member supported by and extending forwardly from the back end member toward a retainer member, the product arm member structured to display the merchandise via a self-facing configuration such that merchandise when displayed on the retail display hook migrates forwardly toward the retainer member with the retainer member preventing merchandise from falling off the product arm member; and a lubricious surface on at least a portion of the product arm member, the lubricious surface configured to provide a reduced static coefficient of friction relative to a powder coated display hook for merchandise being self-faced on the product arm member; and wherein the lubricious surface enables the retail display hook to self face a one-pound article at a force of no more than about 2.1 ounces when the retail display hook is level.

2. A retail display hook for displaying merchandise, the retail display hook comprising:

a back end member structured for attachment to a vertical support; and a product arm member supported by and extending forwardly from the back end member toward a retainer member, the product arm member structured to display the merchandise via a self-facing configuration such that merchandise when displayed on the retail display hook migrates forwardly toward the retainer member with the retainer member preventing merchandise from falling off the product arm member; and a lubricious surface on at least a portion of the product arm member, the lubricious surface configured to provide a reduced static coefficient of friction relative to a powder coated display hook for merchandise being self-faced on the product arm member; and wherein the approximate near zero static coefficient of friction is less than 0.1.

* * * * *